United States Patent [19]

Sloan

[11] Patent Number: 4,895,329

[45] Date of Patent: Jan. 23, 1990

[54] FLASHLIGHT CLAMP

[76] Inventor: Charles B. Sloan, Apt. No. 6, 11351 N.E. Glisan, Portland, Oreg. 97220

[21] Appl. No.: 357,316

[22] Filed: May 24, 1989

[51] Int. Cl.[4] ..... A47G 29/00

[52] U.S. Cl. ..... 248/229; 248/316.7; 362/396

[58] Field of Search ..... 248/229, 231.5, 231.6, 248/231.8, 316.7, 316.1, 103; 362/396, 421

[56] References Cited

U.S. PATENT DOCUMENTS

| | | | |
|---|---|---|---|
| 1,141,152 | 6/1915 | Stahl | 248/229 |
| 1,561,603 | 11/1925 | Glade | 362/421 |
| 1,906,874 | 5/1933 | Platt | 248/316.7 |
| 2,433,314 | 12/1947 | White | 248/231.8 |
| 2,465,519 | 3/1949 | Eastman | 362/396 |
| 2,524,173 | 10/1950 | Peterson | 362/396 |
| 2,727,137 | 12/1955 | Oharenko | 362/390 |
| 2,795,834 | 6/1957 | Szoke | 248/316.7 |
| 3,222,514 | 12/1965 | Thornton | 362/396 |
| 3,591,115 | 7/1971 | Hibbard | 248/122 |
| 4,399,498 | 8/1983 | Bacevius | 362/396 |
| 4,628,777 | 12/1986 | Guarr | 248/231.5 |

*Primary Examiner*—Ramon O. Ramirez
*Assistant Examiner*—Robert A. Olson
*Attorney, Agent, or Firm*—Chernoff, Vilhauer, McClung & Stenzel

[57] ABSTRACT

A clamp for holding a flashlight in position, while removably securing it to a support, having a generally U-shaped retaining member that is resistant to misbending or overbending and a threaded connector, cooperative with the retaining member, to enable precise adjustment of gripping tension on the flashlight body.

2 Claims, 1 Drawing Sheet

FLASHLIGHT CLAMP

BACKGROUND OF THE INVENTION

This invention relates to a flashlight holding and positioning device suitable for removable attachment to a suitable support and more particularly to such a holding device with adjustable clamping jaws adaptable to a variety of standard flashlight sizes.

In the prior art, holding and positioning devices of the type referred to for flashlights or other portable lighting equipment are found, but each has drawbacks not present in the present invention. In Oharenko, U.S. Pat. No. 2,727,137, for example, a clamping device is disclosed on which is mounted a threaded light bulb receptacle adaptable to only one size bulb and requiring an external power supply to light that bulb. Other known holding devices are capable of engaging a flashlight but only hold one size of flashlight, or require modification either in or on the surface of the flashlight body, e.g. Thornton, U.S. Pat. No. 3,222,514, or rely solely on U-shaped metallic spring arms to adapt the holding device to different flashlight sizes. With this last-mentioned approach, disclosed in Peterson, U.S. Pat. Nos. 2,524,173, and Bacevius, 4,399,498, after repeated bending of the spring arms in order to achieve the proper engaging size, the radius of curvature of one of the arms will vary markedly from that of the other arm, thus preventing a tight hold on the cylindrical flashlight body. Furthermore, because the spring arms must be thin enough so that the user may manually bend them to accommodate different flashlight sizes, the arms will tend to be relatively weak and break after repeated size changes. A third disadvantage is that bending of the spring arms does not provide a well controlled tension for a given flashlight size, so that the flashlight will either tend to slip out if the tension is too light, or acquire a marred surface if the tension is too heavy, as the flashlight is slid crosswise relative to the U-shaped arms of the holding device to adjust the positioning of the flashlight's light beam.

SUMMARY OF THE PRESENT INVENTION

Accordingly, a principal object of the present invention is to provide a flashlight holder and positioner, of the type adapted to be removably attached to a suporting surface, wherein the tension in the U-shaped arms that retain the flashlight by clamping action is adjustable without need for manual manipulation thereof through bending or otherwise.

A further object of the present invention is to provide a flashlight holder and positioner wherein the tension in the U-shaped arms that retain the flashlight may be controlled with a high degree of precision.

To achieve tension adjustment in the retaining arms, without manual manipulation of the arms by bending or otherwise, the invention relies on a threaded connector, such as a bolt or a screw, whereby a turning movement of the threaded connector results in tension adjustment of the retaining arms. More specifically, a specially-shaped retaining member is provided whose sides include retaining arm portions, and the bottom of the retaining member includes a compressible portion having a bowed center bending upwards like a bow towards the retaining arms. When this bottom portion is rested on a flat base, and a threaded connector is passed through a hole in this bottom portion into a threaded hole in the base, then, as the threaded connector is turned further into the base, the bow-like bottom of the retaining member will flatten out and the retaining arms will be brought closer together, thereby increasing the tension on the body of the flashlight. Conversely, if the threaded connector is turned away from the flat base, the bow-like bottom portion resumes its curved shape and the retaining arms are pulled further apart, thereby relaxing tension on the flashlight body.

It will be recognized that utilization of a threaded connector for tension adjustment permits much stiffer material to be used in the retaining member than would be possible if the tension adjustment needed to be done by manual bending of the arms. Furthermore, the retaining arm portions of the retaining member maintain a constant radius of curvature throughout the tension adjustment process, thereby preventing one arm from assuming a different curvature than the other arm. Finally, tension may be precisely controlled so that, for example, a user may switch back and forth between flashlights of differing sizes using predetermined turns, inward or outward, of the threaded connector.

A second aspect of the present invention provides that the flat base portion is disk-like in shape thereby providing constant tension without regard to alignment of the retaining member along the plane of the flat base. To the disk is connected a pivoting ball portion so that the flat base, and the retaining member, may be swivelled in any direction, with the result that the light beam may be directed wherever it is required.

The foregoing and other objectives, features, and advantages of the invention will be more readily understood upon consideration of the following detailed description of the invention, taken in conjunction with the acccompanying drawings.

DETAILED DESCRIPTION OF THE INVENTION

Figure 1:
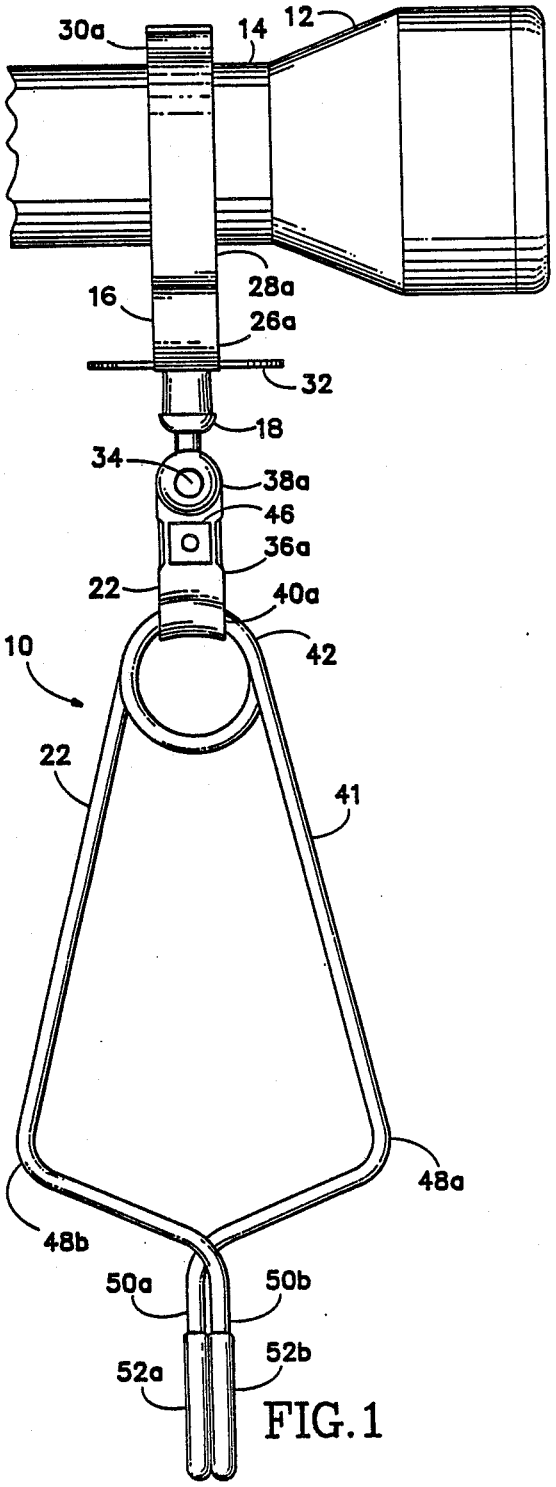
FIG. 1 is an elevated front view of an exemplary embodiment of the present invention operationally holding a conventional cylindrical-bodied flashlight.
Figure 2:
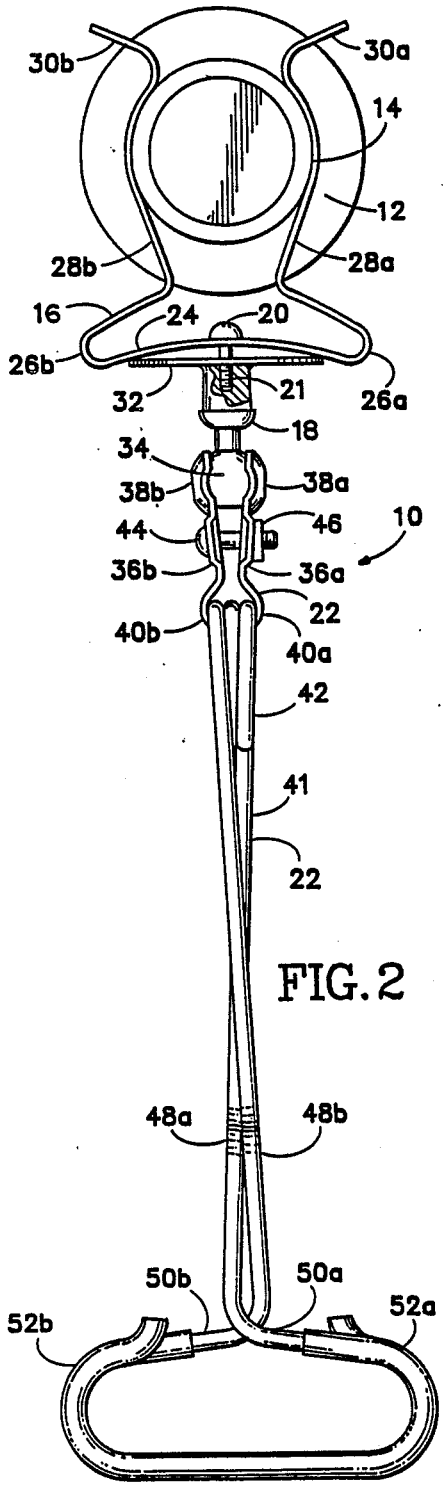
FIG. 2 is a side view, partially in section, of the embodiment of FIG. 1.

FIGS. 1 and 2 show an exemplary flashlight clamp 10 constructed in accordance with the present invention and shown in operation with a conventional flashlight 12 of a standard size having a longitudinally-extending cylindrical body. Such an assembly is useful wherever an area must be illuminated while one's hands are kept free, and is of particular advantage where external power outlets are unavailable or dangerous to use, such as at a campsite or wet worksite.

The flashlight clamp 10 comprises a U-shaped retaining member 16 of resilient spring-like material mounted on a support member 18 by a threaded connector 20, such support member being connected to a clamping member 22 that is capable of clamping to any suitable support surface or structure which is proximate an area where illumination is desired.

The U-shaped retaining member 16 is preferably fabricated from a single strip of high quality spring steel composed of an austenitic chromium nickel steel alloy that has been thermally processed for a suitable high yield strength (preferably greater than 100 psi). The strip, being formed into the shape indicated by FIG. 2, with particular features described hereafter, may be made larger or smaller depending on the range of sizes in the flashlight bodies 14 to be held. A steel clip having the characteristics described is available from the Arthur I. Platt Company, of Milford, Conn.

As depicted in FIG. 2, the U-shaped retaining member 16 has an arcuately bent compressible portion 24, a pair of leg portions 26*a* and 26*b*, a pair of arcuately bent retaining arm portions 28*a* and 28*b*, and a pair of flared receiving portions 30*a* and 30*b*. The compressible portion 24 is mounted on the flat base portion 32 of support member 18 by a threaded connector 20 which may be a screw, bolt, or other such item. As the threaded connector 20 is turned deeper downward into the threaded bore 21 of the flat base portion 32, the compressible portion 24 will flatten out, thereby causing leg portions 26*a* and 26*b* to be brought toward each other. This in turn will bring retaining arm portions 28*a* and 28*b* closer together so that the tension, on the cylindrical body 14 of the flashlight being held, will increase. This increase in tension may be realized in precisely controlled increments, each increment corresponding to a single turn of the threaded connector. To release the tension on the body 14 of the flashlight 12 the threaded connector 20 may be turned upward out of its threaded bore 21. The compressible portion 24 will then resume its arcuate bend, thereby forcing the leg portions 26*a* and 26*b* further apart and likewise forcing the retaining arm portions 28*a* and 28*b* apart. Again, the tension may be relieved in precisely controlled increments corresponding to single turns of the threaded connector 20 in an outward direction.

The high yield strength of the steel used to manufacture the U-shaped retaining member 16 prevents the retaining arm portions 28*a* and 28*b* from becoming bent out of shape during use. Specifically, the retaining arm portions 28*a* and 28*b* are of sufficient thickness, resiliency and composition to retain their characteristic U-shape despite the repeated application of severe bending forces. This structural robustness prevents the retaining arms from assuming markedly different curvatures, a result that would lessen the retaining force. Nor are the retaining arm portions 28*a* and 28*b* subject to repeated changes in shape that might cause failure in weaker arms. Of course, the retaining member 16 is not made so rigid that it becomes impossible to turn the threaded connector 20. To facilitate insertion of the flashlight body 14 between the stiff retaining arms 28*a* and 28*b*, a pair of flared receiving portions, 30*a* and 30*b* are provided at the ends thereof.

The support member 18 is provided with a flat base portion 32 on which the retaining member 16 is mounted. This flat base portion is preferably of disklike shape so that any rotation of the retaining member 16 around the threaded connector 20 does not change the tension applied by retaining arms 28*a* and 28*b* on the flashlight body.

The support member 18 preferably includes a pivoting ball portion 34 to which the clamping member 22 may be pivotally connected. The embodiment depicted includes a pair of arm brackets 36*a* and 36*b* on the clamping member for this purpose. Each arm bracket has a cup-like end 38*a* and 38*b*, respectively, in which the pivoting ball portion 34 is freely rotatable. This free rotation allows the flashlight to be directed as desired. At their other ends the arm brackets 36*a* and 36*b* have jawed ends 40*a* and 40*b*, respectively, serving to secure the arm brackets to coiled spring portion 42 due to the gap-closing force provided by the threaded connector 44 tightly secured to nut 46. The simplicity, and maintainability, of the arm brackets 36*a* and 36*b* will be recognized.

Referring now to FIG. 1, the clamping member 22 is further comprised of spring-biased gripping member 41. The spring-biased gripping member includes a coiled spring portion 42, clamp handle portions 48*a* and 48*b*, and clamp heads 50*a* and 50*b*. The clamp heads are each covered with plastic strips 52*a* and 52*b* to prevent marring of the surface on which the gripping member is clamped. As the clamp handle portions 48*a* and 48*b* are brought together, for example, by being squeezed in the hand of the user, clamp heads 50*a* and 50*b* will be forced apart in a spaced relationship suitable for placement on a suitable mounting surface. This reverse action attribute, where an inward pressure results in an outward separation, enables the user to conveniently operate the spring-biased gripping member 41 with one hand while using the other hand to adjust the flashlight's position.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited by the claims which follow.

What is claimed is:

1. A flashlight holder and positioner comprising:

(a) a support member including a flat disk portion having respective top and bottom circular faces, with a threaded bore being centrally defined in said top circular face of said flat disk portion, and a pivoting ball portion transversely disposed from, and fixedly attached to, said bottom circular face of said flat disk portion;

(b) a threaded connector engaging said threaded bore;

(c) a U-shape retaining member formed from a single strip of resilient spring-like material, said member including an arcuately-bent compressible portion having a central opening therein and a pair of opposed ends, said compressible portion thereof engaging said base portion of said support member in a manner wherein said opposed ends of said retaining member press against said top circular face of said flat disk portion of said support member, said retaining member being secured to said top circular face by said threaded connector passing through said central opening, said retaining member further having a pair of leg portions each extending from a respective opposed end of said compressible portion and folding back towards each other in opposing relationship, a pair of arcuately-bent retaining arm portions each extending from a respective leg portion, said retaining arm portions acting together to clamp a flashlight body therebetween in tension gripping fashion, said opposed ends pressing against said top circular face of said disk so as to permit said retaining member to be rotated about said threaded connector without creating a change in said tension applied by said retaining arms on the flashlight body, said tension being adjustable by rotational positioning of said threaded connector relative to said bore; and (d) a clamping member connected to said pivoting ball portion of said support member for detachably clamping said holder/positioner to a suitable support surface.

2. A flashlight holder and positioner according to claim 1 wherein said pair of leg portions of said retaining member each extend beyond the edge of, and below the plane of, said top circular face of said disk from a respective opposed end of said compressible portion and each of said leg portions folds back toward the other above the plane of said top circular face of said disk.

* * * * *